US006899116B2

(12) United States Patent
Xu et al.

(10) Patent No.: US 6,899,116 B2
(45) Date of Patent: May 31, 2005

(54) PRESSURE VESSEL SYSTEMS AND METHODS FOR DISPENSING LIQUID CHEMICAL COMPOSITIONS

(75) Inventors: Mindi Xu, Naperville, IL (US); Hwa-Chi Wang, Naperville, IL (US); Herve E. Dulphy, Marseille (FR)

(73) Assignee: American Air Liquide, Inc., Fremont, CA (US)

( * ) Notice: Subject to any disclaimer, the term of this patent is extended or adjusted under 35 U.S.C. 154(b) by 0 days.

(21) Appl. No.: 10/830,953

(22) Filed: Apr. 23, 2004

(65) Prior Publication Data

US 2004/0194336 A1 Oct. 7, 2004

Related U.S. Application Data

(62) Division of application No. 10/024,087, filed on Dec. 17, 2001, now Pat. No. 6,736,154.
(60) Provisional application No. 60/264,274, filed on Jan. 26, 2001.

(51) Int. Cl.[7] ..... F04F 1/06
(52) U.S. Cl. ..... 137/14; 137/211
(58) Field of Search ..... 137/14, 208, 211

(56) References Cited

U.S. PATENT DOCUMENTS 3,035,888 A * 5/1962 Massey ..... 137/209
4,545,801 A * 10/1985 Miyajiri et al. ..... 137/211
6,076,541 A * 6/2000 Pozniak et al. ..... 137/14

* cited by examiner

*Primary Examiner*—Gerald A. Michalsky
(74) *Attorney, Agent, or Firm*—Christopher J. Cronin

(57) ABSTRACT

Apparatus and processes are presented to contact a dry, preferably high purity inert gas with a chemical composition in a pressure vessel, or a wetting composition, to form a wet inert gas, which is then used to pressurize the chemical composition out of the pressure vessel. No additional space is needed for an external humidifier. Since a very small amount of vapor is needed to form a wet inert gas, the composition of chemical composition will not be significantly affected.

8 Claims, 5 Drawing Sheets

PRESSURE VESSEL SYSTEMS AND METHODS FOR DISPENSING LIQUID CHEMICAL COMPOSITIONS

CROSS-REFERENCE TO RELATED APPLICATIONS

This application is a division of application Ser. No. 10/024,087, filed Dec. 17, 2001, now U.S. Pat. No. 6,736,154, which claims the benefit of provisional application Ser. No. 60/264,274, filed Jan. 26, 2001, which is incorporated by reference in its entirety.

BACKGROUND OF THE INVENTION

1. Field of the Invention

This invention is related to chemical composition delivery systems and methods, especially to the chemical delivery systems for electronics specialty chemical compositions, including CMP slurries for wafer polishing.

2. Related Art

Process chemicals for semiconductor manufacturing are usually delivered from bulk containers to user stations with so called chemical delivery systems. High-pressure inert gases, such as nitrogen gas, have become popular for driving chemical compositions from chemical containers to user stations. Compared to the delivery systems having a pump, systems employing high-pressure inert gas for chemical delivery have the advantages of delivery from further distance, and also smooth and pulse-less delivery, thus avoiding impurity shedding from the components of the delivery system.

Although the advantages of such a chemical delivery method have been realized and the method has been practiced in large extent, some concerns and problems have arisen when some of the semiconductor process chemical compositions are delivered with this type of delivery system. For example, inert gas, such as nitrogen gas, will readily dissolve into some of these process chemicals during compression process and eventually form dry spots on wafers. These dry spots become manufacturing defects and seriously reduce the production yield of semiconductor manufacturing. To avoid and eliminate the problem of gas dissolving in chemical compositions, a new delivery system with a bladder installed inside the pressure vessel has been invented. With this method and apparatus, high-pressure nitrogen gas is filled into the bladder to pressurize chemical compositions outside of the bladder. Since there is no direct contact between the chemical composition and nitrogen gas, dissolving of nitrogen gas into chemicals is avoided. Furthermore, chemical compositions will not change in assay due to chemical evaporation.

When delivering aqueous chemical compositions using direct contact with an inert gas, such as slurry compositions used for polishing wafer surfaces, water and other chemical compounds in the chemical composition at the composition surface and composition residuals on the container surfaces will be rapidly lost into the inert gas when the high-pressure inert gas directly contacts with the chemical composition. This is because inert gases are usually very dry and very pure. Amounts of chemical compounds such as water in the chemical composition will change because of evaporation. This change in chemical composition may make the chemical composition function improperly when it is used in the semiconductor manufacturing process. When water evaporates into inert gas, a dry film or dry residuals could be formed with much less water and more concentrated compositions of less volatility. In the case of slurry compositions, this dry film or dry residuals will be in the form of agglomerated particles of larger sizes. These agglomerated particles eventually will be delivered with chemical compositions to user stations and produce scratches on wafer surfaces. This problem could be solved by using the above mentioned bladder technology by preventing the direct contact of nitrogen gas with chemical composition. With this technology, a thin and flexible material that is compatible with the chemical composition must be carefully selected for the bladder.

To overcome the shortcomings of water evaporation into inert gas, a moisturizer can be used to moisturize the nitrogen gas prior to its going into the pressure vessels to pressurize chemical compositions, such as depicted in U.S. Pat. No. 6,076,541. When the moisturized nitrogen gas contacts with chemical compositions, mass transfer of water in the nitrogen gas and the chemical composition is significantly reduced or completely eliminated. Therefore, there is no, or very little, dry residuals or dry film formed within the pressure vessels. However, there are still some drawbacks. First, more space will be needed for accommodating a humidifier near to the pressure vessel. This could be a serious problem because in a semiconductor manufacturing facility, space is always limited. Additional equipment to occupy space is not always permitted and space is not always affordable. Second, moisturized nitrogen gas may create some problems in the system operation. Since moisturized nitrogen flows through a relative long line into the pressure vessel, moisture in nitrogen gas can be condensed in the line because of changes of physical condition. This condensate could block up valves and make the valves malfunction. The condensate could also be carried further into the pressure vessel to dilute the chemical compositions. Chemical composition change by such kind of dilution is forbidden because the composition of chemical compositions must be precisely controlled to meet user's specification. Further, some chemical compositions, such as hydrogen peroxide in the chemical composition, will evaporate into high purity inert gas even though it is moisturized. Hence, chemical compositions will change when the chemical composition is delivered with such a method although such a change in chemical composition may not be a serious problem for some cases.

It would therefore be advantageous, and an advance in the chemical delivery art, if chemical delivery systems and methods could be designed that reduce or avoid the above-noted drawbacks.

SUMMARY OF THE INVENTION

In accordance with the present invention, novel and simple apparatus and methods are proposed to reduce or eliminate the problems of dry residuals and dry film during liquid chemical composition delivery with pressure vessels, as well as problems associated with previously known humidification systems. As used herein the terms "system" and "apparatus" are used interchangeably.

As used herein the term "liquid chemical composition" means:

- a fluid that flows under the presence of pressure, gravity, or combination;
- may be Newtonian or non-Newtonian fluid;
- may be aqueous, non-aqueous or combination;
- may be a combination of components (liquid, solid, and gaseous).

Preferably, liquid chemical compositions which may benefit from the present invention are substantially aqueous, Newtonian fluids having a combination of ingredients, including, in some embodiments, one or more organic compounds, such as reactive diluents, non-reactive diluents, solvents, co-solvents, coupling agents, and the like, and abrasive matter, for example dispersed in individual particles, or agglomerates of individual particles. Chemical-mechanical planarization slurries and chemical-mechanical polishing slurries are two preferred liquid chemical compositions. Suitable organic solvents might include organic alcohols, ketones, acids and the like, isopropyl alcohol, for example.

A first aspect of the invention is an apparatus for delivery of liquid chemical compositions. A first apparatus embodiment comprises:

a) a pressure vessel comprising an inlet and an outlet for a liquid chemical composition, and a vapor space, the pressure vessel adapted to contain the liquid chemical composition, the liquid chemical composition having a vaporizable portion (preferably a major portion of water) therein;

b) means for contacting (preferably bubbling) a dry, preferably high purity inert gas with at least a portion of the liquid chemical composition in the pressure vessel to transfer at least a portion of the vaporizable portion from the chemical composition to the inert gas to form a wet inert gas in the vapor space; and c) means for pressurizing the chemical composition out of the vessel using the wet, high purity inert gas.

Preferred apparatus within this embodiment are those wherein the inlet and the outlet are each legs of a tee connection, a remaining leg of the tee connected to the pressure vessel. Also preferred are apparatus wherein the dry, preferably high purity inert gas is adapted to be sparged into the pressure vessel near a bottom of the vessel through an inert gas inlet conduit, the inert gas inlet conduit having an exit end, preferably the exit end of the inert gas inlet having a sparging device attached thereto.

As used herein the term "dry" means the inert gas preferably has a moisture content less than 10 percent relative humidity (RH), more preferably less than 1 percent RH. "High purity" as used herein when referenced to the inert gas means the inert gas has less than 10 parts per million (ppm) total impurity (inorganic compounds and organic compounds), more preferably less than 5 ppm. "Ultra high purity" as used herein when referenced to the inert gas means the inert gas has less than 1 part per billion total impurity (inorganic compounds and organic compounds). One preferred dry inert gas is that referenced in Semiconductor Equipment and Materials International (SEMI) standard C3.29-96, Standard for Nitrogen, Bulk Gaseous, 99.9995% Quality (1999), incorporated herein by reference. The term "wet" means a gas composition having components selected from the group consisting of water vapor, organic vapor, inorganic vapor, and combinations thereof.

A second apparatus embodiment of the invention for delivery of liquid chemical compositions comprises:

a) a pressure vessel comprising a first compartment and a second compartment, the first compartment and the second compartment divided by a dividing element;

b) the first compartment connected to an inlet conduit for a wetting composition, and a waste conduit for allowing the wetting composition to be delivered to waste, the dividing element functioning to establish a liquid level of the wetting composition in the first compartment, the first compartment also having a dry, preferably high purity inert gas inlet conduit having an end positioned (preferably adapted to be submerged into the liquid chemical composition to be delivered to waste) to provide contact in the first compartment between the inert gas and the wetting composition to form a wet inert gas, the first compartment further having an outlet for the wet inert gas;

c) the outlet for the wet inert gas connected to the second compartment by a wet inert gas conduit;

d) the second compartment connected to an inlet conduit and an outlet conduit for a liquid chemical composition, and a vapor space, the vapor space connected to the first compartment via the wet inert gas conduit.

Preferred apparatus of the second embodiment are those wherein the conduit is part of a means for monitoring level of the liquid chemical composition inside the second compartment. Also preferred are those apparatus wherein the wet inert gas conduit includes a means for removing liquid droplets from the wet inert gas, such means selected from screens, meshes, mist eliminators, coalescers, adsorbent materials, absorbent materials, molecular sieves, zeolites, filters, heat exchangers, condensers, cryocoolers and the like.

A third apparatus embodiment for delivery of liquid chemical compositions comprises:

a) a pressure vessel comprising a first compartment and a second compartment, the first compartment and the second compartment divided by a dividing element;

b) the first compartment connected to an inlet conduit for spraying a wetting composition into the first compartment, and a waste conduit for allowing the wetting composition to be delivered to waste, the inlet conduit terminating in a means for spraying the wetting composition into the first compartment, the dividing element functioning to establish a level of the wetting composition in the first compartment, the first compartment also connected to a gas inlet conduit for a dry, preferably high purity inert gas, the gas inlet conduit having a terminal end positioned (preferably above a level of the sprayed portion of liquid chemical composition to be delivered to waste) to allow contact in the first compartment between the inert gas and the wetting composition to form a wet inert gas, the first compartment further having an outlet for the wet inert gas;

c) the outlet for the wet inert gas connected to the second compartment by a wet inert gas conduit;

d) the second compartment having an inlet conduit and an outlet conduit for a liquid chemical composition, and a vapor space, the vapor space connected to the first compartment via the wet inert gas conduit.

A fourth apparatus embodiment of the invention for delivery of liquid chemical compositions comprises:

a) a pressure vessel comprising a first compartment and a second compartment, the first compartment and the second compartment divided by a dividing element;

b) the first compartment connected an inlet conduit for spraying a wetting composition into a chamber formed by a housing, and a waste conduit for allowing the wetting composition to be delivered to waste, the inlet conduit terminating in a means for spraying the wetting composition into the chamber, (the dividing element preferably functioning to establish a level of the wetting composition in the chamber), the housing also connected to a gas inlet conduit for a dry, preferably high purity inert gas, the gas inlet conduit and housing adapted to allow contact between the inert gas and the wetting composition in the chamber, the housing further having means for allowing wet inert gas to move into the first compartment;

c) the dividing element having means for allowing passage of said wet inert gas from the first compartment to the second compartment;

d) the second compartment connected to an inlet conduit and an outlet conduit for a liquid chemical composition, and a vapor space, the vapor space fluidly connected to the first compartment via the means for allowing passage in the dividing element.

A fifth apparatus embodiment is a slight modification of the fourth embodiment, and includes the feature that the housing has one or more means for allowing the wetting composition, after contacting the dry inert gas, to traverse through the housing and fall into the second compartment. Preferably, the means for allowing the wetting composition to traverse through the housing are located at location selected from the group consisting of the bottom of the housing, the sidewall of the housing, or both.

It will be understood as included within the scope of the invention that there may exist a plurality of housings inside the first compartment, each having a gas inlet conduit and a conduit for spraying wetting composition into each housing.

A second aspect of the invention includes methods of delivering a liquid chemical composition. A first preferred method embodiment comprises:

a) filling a pressure vessel with a liquid chemical composition comprising a vaporizable component (preferably including moisture), the pressure vessel having a vapor space and adapted to contain the liquid chemical composition;

b) contacting (preferably by bubbling) a dry, preferably high purity inert gas with at least a portion of the liquid chemical composition in the pressure vessel to transfer at least a portion of the vaporizable composition from the liquid chemical composition to the dry inert gas to form a wet inert gas in the vapor space; and c) pressurizing the liquid chemical composition out of the pressure vessel using the wet inert gas in the vapor space.

A second method embodiment of delivering a liquid chemical composition comprises the steps of:

a) providing a pressure vessel comprising a first compartment and a second compartment, the first compartment and the second compartment divided by a dividing element;

b) at least partially filling the first compartment with a wetting composition, the dividing element functioning to establish a level of the wetting composition in the first compartment;

c) flowing a dry, preferably high purity inert gas into the first compartment in a manner to provide contact between the inert gas and the wetting composition, thus forming a wet inert gas, the first compartment further connected to an outlet conduit for the wet inert gas;

d) flowing the wet inert gas into the second compartment through a conduit; and e) substantially filling the second compartment with a liquid chemical composition allowing a vapor space, the second compartment connected to the first compartment via the conduit.

A third method embodiment of delivering a liquid chemical composition comprises the steps of:

a) providing a pressure vessel comprising a first compartment and a second compartment, the first compartment and the second compartment divided by a dividing element;

b) spraying into the first compartment a wetting composition, the dividing element functioning to establish a level of the wetting composition in the first compartment;

c) flowing a dry, preferably high purity inert gas into the first compartment (preferably above a level of the wetting composition), and contacting the inert gas with the wetting composition, thus forming a wet inert gas;

d) flowing the wet inert gas from the first compartment into the second compartment through a conduit; and e) substantially filling the second compartment with a liquid chemical composition, allowing a vapor space, the second compartment connected to the first compartment via the conduit.

A fourth method embodiment of delivering a chemical composition comprises the steps of:

a) providing a pressure vessel comprising a first compartment and a second compartment, the first compartment and the second compartment divided by a dividing element, the first compartment having a chamber formed by a housing;

b) spraying into the chamber a wetting composition, the dividing element functioning to establish a level of the wetting composition in the chamber;

c) flowing a dry, preferably high purity inert gas into the chamber to provide contact between the inert gas and the wetting composition, thus forming a wet inert gas;

d) flowing the wet inert gas into the second compartment through a conduit; and e) substantially filling the second compartment with a liquid chemical composition, allowing a vapor space, the vapor space connected to the first compartment via the conduit.

The first apparatus embodiment of the invention allows contacting a dry, preferably high purity inert gas with a wetting composition, the wetting composition being the liquid chemical composition to be delivered. Contacting occurs in a pressure vessel to form a wet inert gas, which is then used to pressurize the liquid chemical composition out of the pressure vessel. Therefore, no additional space is needed for an external humidifier as in previous apparatus and methods. Since preferably a very small amount of vapor is needed to saturate the dry inert gas, the assay of the liquid chemical composition will not be substantially affected when the wetting composition is the liquid chemical composition being delivered. The vapor content of the wet inert gas can also be easily controlled by carefully flowing the dry inert gas through the liquid chemical composition, in the first embodiment.

Other preferred embodiments of the presented invention feature two compartments within a pressure vessel of integral body. Liquid chemical composition to be delivered is supplied into one compartment, and a relatively small amount of a wetting composition (which may be the liquid chemical composition being delivered, if desired) and inert gas is supplied into another compartment in such a manner as to cause contact between the dry inert gas and the wetting composition. The two compartments communicate with each other through means described herein. Hence, the liquid chemical composition is propelled with wet inert gas that comprises chemical vapors, preferably water vapor, but not limited thereto. The problem of liquid chemical being lost into the dry inert gas is prevented while the dry residual problem is eliminated at the same time.

With one preferred embodiment, the two compartments as mentioned above communicate with each other through a conduit, allowing wet inert gas to flow into and out of the compartments.

With an additional preferred embodiment, the two compartments as mentioned above communicate with each other through a series of means, preferably small openings such as holes, louvers, channels, and the like in the dividing means separating the two compartments.

All of the embodiments in this invention are provided with necessary control and isolation valves for discharging and recharging liquid chemical compositions into the pressure vessels, introducing in and draining out of liquid chemical composition, and filling and releasing inert gas. The preferred embodiments of the pressure vessels can be operated for delivering chemical compositions with one, or more than one, pressure vessels in parallel. Two or more pressure vessels are usually installed in parallel to continuously deliver liquid chemical compositions. Preferred embodiments of pressure vessels of this invention can also be arranged in series to recharge liquid chemical compositions from one pressure vessel to another.

These and other advantages and aspects of the invention are demonstrated with reference to the following drawings and description of preferred embodiments, although not limited thereto.

DESCRIPTION OF PREFERRED EMBODIMENTS

While the methods and apparatus of the present invention are most pertinent to delivery of slurries to semiconductor wafer CMP equipment, the methods and apparatus of the invention can be employed in any situation where inert gas is used to pressurize a compartment and moisture loss is a problem. For example, in the production of certain abrasive articles, slurries are used to produce "structured abrasives". See generally Culler, U.S. Pat. No. 5,368,619, incorporated herein by reference. In delivering slurries to be cured into abrasive coatings, the slurries may be moved using inert gas, and the principles of the present invention may be employed. The following discussion focuses on the semiconductor industry, since a primary benefit is the reduction of space needed for wetting the inert gas, however, it is understood that the invention is not limited to use in any particular setting.

Chemical compositions have been used for a variety of purposes during integrated circuit manufacturing process. For example, aqueous compositions of silicon dioxide powders with other necessary chemical compositions are used to polish or planarize wafer surfaces. This process is usually referred to as chemical mechanical polishing or chemical mechanical planarization (CMP) in semiconductor manufacturing processing. To assure the quality of planarization process, the CMP slurry composition is preferably controlled within a specific range of chemical additives and particle size distributions. Chemical additive concentrations are usually monitored and adjusted on-line to meet their specifications. Particle size is preferably monitored and controlled by filtrating unneeded particles of larger than a few micrometers in diameter that could be formed by agglomeration processes because large particles can scratch wafer surfaces. Therefore, formation of large size particles is preferably avoided during the chemical composition delivery process.

Figure 1:
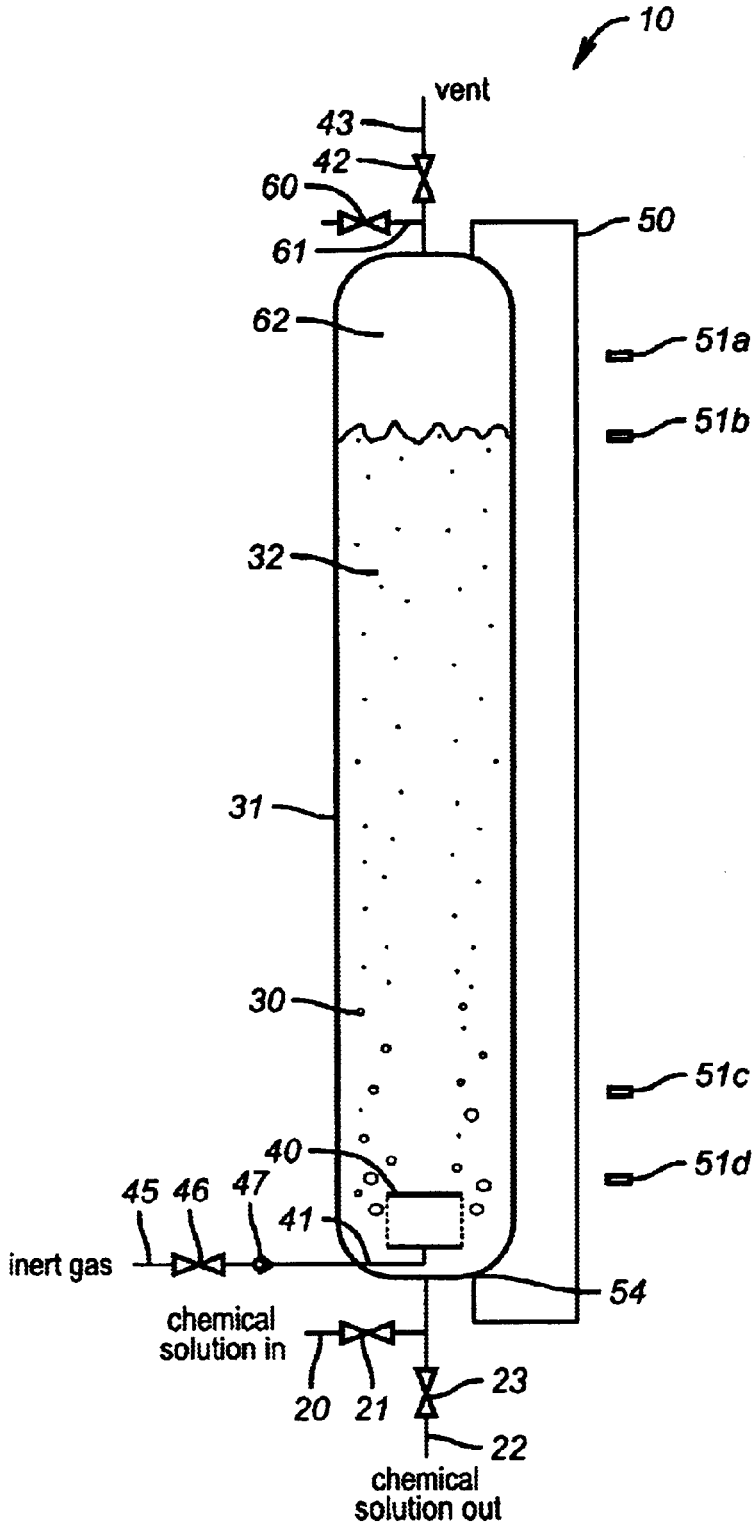
FIG. 1 is a process schematic, side elevation view of a preferred embodiment of an apparatus and method to moisturize inert gas by bubbling the gas through chemical composition.

Such chemical compositions are usually delivered with a pressure vessel system through necessary distribution conduits. FIG. 1 illustrates a preferred embodiment of an apparatus 10 of this invention for delivering chemical compositions. A pressure vessel 31 contains chemical composition 32 for delivery. A chemical composition inlet conduit 20 with a control valve 21 attaches to container 31 for supplying chemical compositions into pressure vessel 31. A chemical composition outlet conduit 22 with a control valve 23 attaches to the container to allow chemical composition be delivered to user station or other containers. Conduits 20 and 22 may alternatively be separately connected to pressure vessel 31. Both conduits 20 and 22 may be any material compatible with the chemical composition. Preferred materials include metals such as stainless steel, and plastic materials such as polytetrafluoroethylene (PTFE), perfluoroalkoxy resin (PFA), high-density polyethylene, and polypropylene. The diameter of conduits 20 and 22 preferably ranges from 0.125 inch (0.32 cm) to about 1.0 inch (2.54 cm).

A side tube 50 attaches to pressure vessel 31 near the top of pressure vessel 31 with one end 52 and at bottom with another end 54 for establishing communication between the top and the bottom portions inside pressure vessel 31.

Level sensors 51*a*, 51*b*, 51*c*, and 51*d* are preferably mounted onto the side tube to monitor the levels of chemical composition inside pressure vessel 31. Side tube 50 can be the same or different plastic material as conduits 20 and 22, but preferably range in inside diameter from 0.5 inch (1.3 cm) and larger. Level sensors 51*a*, 51*b*, 51*c*, and 51*d* are preferably selected from optical or capacitive types as usually used by those that are familiar with the level measurement art. Other types of level sensor such as an ultrasonic can also be used for level monitoring. When ultrasonic level sensors are used, they can be directly attached onto pressure vessel 31 at different locations. Therefore, side tube 50 may not be necessary in this case.

A conduit 45 with a control valve 46 and a check valve 47 for high-pressure inert gas passes through pressure vessel 31 wall near the bottom and is connected with a diffuser 40. Conduit 45 can be also the same material as those for the conduits 20 and 22. Diffuser 40 is preferably a membrane cartridge similar to a filter cartridge that allows inert gas to flow through. Diffuser 40 can also comprise one or more pipes with a plurality of holes to allow inert gas to flow through. In any physical construction, diffuser 40 is preferably a material compatible with the chemical compositions to be delivered.

Another conduit 43 with a control valve 42 is attached to pressure vessel 31 to vent pressure vessel 31 when needed. A pressure relief valve 60 is attached to pressure vessel 31 through a conduit 61 to release gases once the pressure inside pressure vessel 31 is higher than a preset pressure. The above mentioned control valves are preferably pneumatic valves comprised of materials compatible with the chemical compositions such as stainless steel, PTFE, PFA, high density polyethylene, and polypropylene.

When operated, chemical compositions are filled into pressure vessel 31 through conduit 20. The amount of chemical composition inside pressure vessel 31 is monitored by level sensors 51*a–d*. Once the composition level reaches a high level monitored by level sensor 51*b*, control valve 21 is closed; Preferably high-pressure, ultra-high purity inert gas such as nitrogen gas is then introduced through conduit 45 by opening control valve 46. The inert gas flows through diffuser 40 and forms small bubbles 30 inside chemical composition 32. The bubble sizes are dependent on the pore or hole size of diffuser 40. It is preferred to have a diffuser produce gas bubbles smaller than 50 mm in diameter, more preferably less than about 5 mm. The gas flow is preferably controlled at flow rate ranging from about 1 standard liter per minute (slpm) to about 100 slpm and at pressure ranging from about 0.5 atmosphere to 5 atmospheres. The gas bubbles rise up through the chemical composition and collect some vapor through their course up. The inert gas fills vapor space 62 above chemical composition 32 and in turn pressurizes chemical composition 32.

The height of pressure vessel 31, or more appropriately, the depth of chemical composition 32, is critical for the gas bubbles to collect enough vapor. The height of pressure vessel 31 is preferably at least 1 meter, and the depth of chemical composition 32 inside pressure vessel 31 is preferably at least 0.5 meter at its high level as monitored by level sensor 51*b*.

The vapor (preferably moisture) content in the inert gas preferably ranges from a relative humidity of about 50 percent to 100 percent, more preferably ranging from about 80 to abut 95 percent, with other chemical vapors in a concentration of up to parts per million level, either with or without the moisture present.

When the chemical composition is to be delivered to one or more user stations, control valve 23 is opened and chemical flows out of pressure vessel 31 through conduit 22 under the vapor-containing inert gas pressure. At this time, vapor-containing inert gas is supplied into vapor space 62 to fill the space left by displaced chemical composition. Therefore, the pressure inside pressure vessel 31 is maintained constant and the chemical composition is delivered at a stable pressure and flow rate. High purity nitrogen gas is preferred because it is widely available and relatively less expensive than any other inert gas. When the composition reaches a low level that is monitored by a level sensor 51*c*, control valves 23 and 21 are closed. The high-pressure inert gas inside pressure vessel 31 is then released by opening control valve 42. At this stage, chemical composition is filled into pressure vessel 31 by turning on control valve 21. Chemical composition can be refilled into pressure vessel 31 and discharged for delivery in cycles as needed. Two or more such pressure vessels can be operated in parallel. When one of the pressure vessels is in refill mode, another one can be in discharge mode to achieve a continuous delivery of chemical composition to one or more user stations.

Pressure vessel 31 is preferably comprised of metal or plastic materials such as stainless steel, PTFE, PFA, high-density polyethylene, polypropylene, glass, and steel coated with one of these plastic or glass materials on its inside surface. Pressure vessel 31 must have a combination of material properties and wall thickness enough to allow the pressure vessel to take pressure up to about 10 atmospheres. The capacity of the pressure vessel preferably ranges from about 1 to about 5000 liters, more preferably ranging from about 20 to 500 liters.

Because the inert gas will now have at least a portion of the vaporizable portion after contacting the chemical composition, vapor molecules in the top layer of the chemical composition and in the composition drops remaining on the interior wall of pressure vessel 31 will not be lost into the inert gas. Therefore, there will be no dry film or dry residual formed. With this preferred embodiment, it is not necessary to have an external humidifier to moisturize the inert gas as in known systems. An advantage with this preferred embodiment is that this preferred embodiment saves space for users and is more cost effective. Another advantage is that the whole delivery system will be more easily operated than previously known systems because it has eliminated some components.

Inert gas bubbles may produce some small droplets of chemical composition after the bubbles burst at the top of the composition surface. These droplets could be spilled onto the interior surface of the pressure vessel walls and eventually drip back into the composition body again. The droplets will never form any dry residuals because the inert nitrogen gas is saturated with vapor. Inert gases preferably do not dissolve in chemical composition. This is because equilibrium between the dissolved and gaseous phase inert gas has usually been well established during the manufacturing and packaging process of the chemical compositions used in semiconductor manufacturing. Additional decomposition due to a high inert gas pressure is negligible because inert gases, such as nitrogen, have very low solubility in aqueous chemical compositions. Inert gas will not contribute any contaminant to chemical compositions if preferred ultra-pure inert gas is used for this purpose. At normal operating conditions (about 20° C.), partial pressure of chemical composition will be very low in nitrogen gas. Therefore, bubbling preferred ultra-high purity nitrogen gas through the chemical composition will not significantly change the assay of the chemical composition. For example, since very small amount of water is needed to saturate nitrogen gas, change of water concentration is also negligible. For example, 35 liters of nitrogen gas at room temperature (about 20° C.), and a pressure of 30 psig needs only 0.37 milliliter (ml) water to become saturated.

Figure 2:
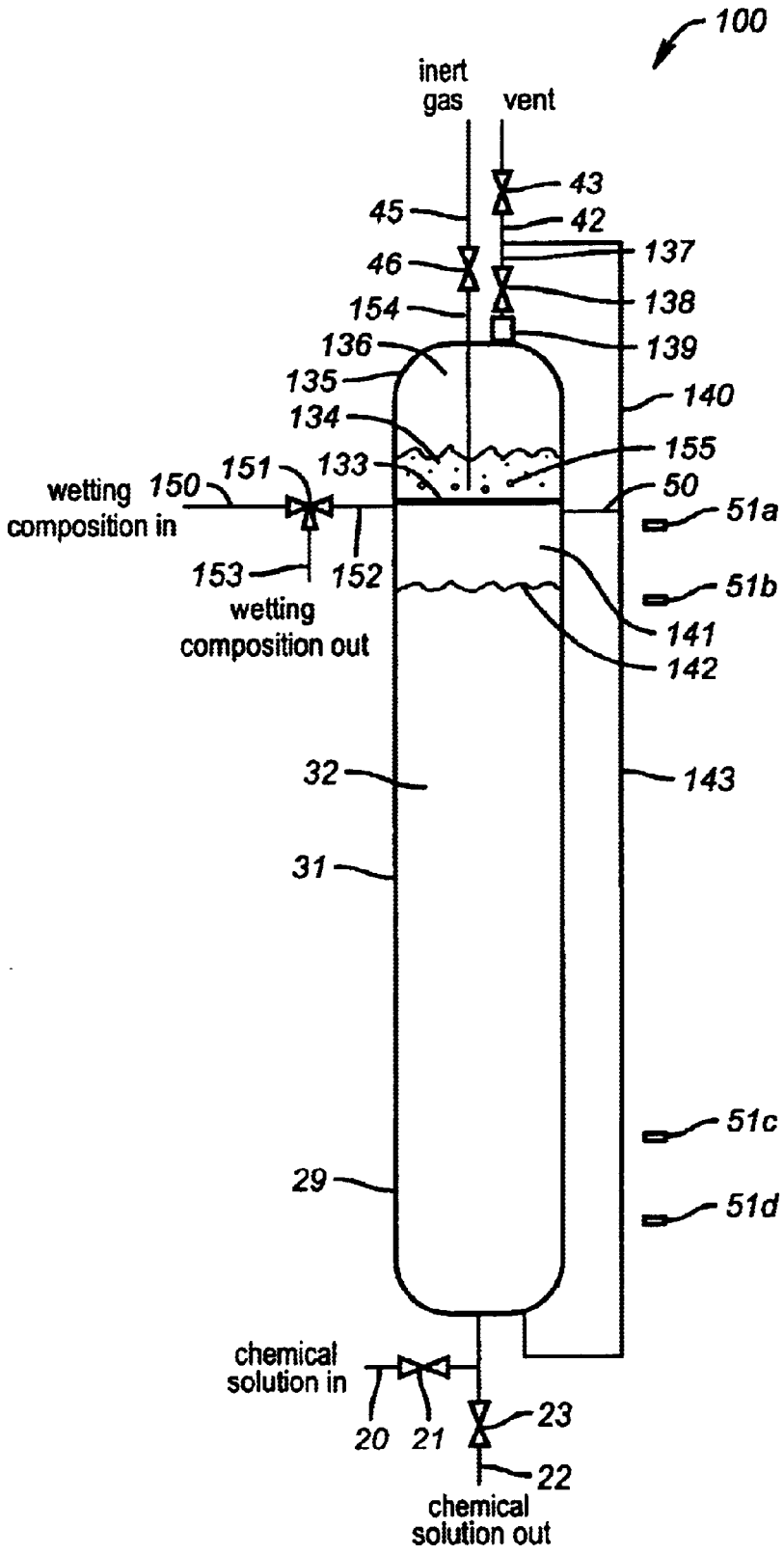
FIG. 2 is a process schematic, side elevation view of a preferred embodiment of a method and apparatus with two compartments and an external conduit for communication between of two compartments.

In an alternative method, chemical composition can be used to provide vapor to inert gas. FIG. 2 illustrates another preferred apparatus 100 of the invention. As illustrated in FIG. 2, apparatus 100 has a pressure vessel 31 for containing chemical compositions. A chemical composition inlet conduit 20 with a control valve 21 is connected to chemical composition compartment 29 of pressure vessel 31 at its bottom for supplying chemical composition to be delivered.

A chemical composition outlet conduit 22 with a control valve 23 is connected to pressure vessel 31 at its bottom for delivering chemical. There is in this embodiment a wetting composition inlet conduit 150 with a control valve 151 for supplying a small portion of a wetting chemical into an inert gas compartment 135 of the pressure vessel. Control valve 151 is optionally a three-way valve with one way to allow wetting composition flow into inert gas compartment 135 and another way to allow wetting composition waste flow out of compartment 135. A wetting composition outlet conduit 153 is preferably connected to three-way valve 151 for discharging the wetting composition.

An inert gas inlet conduit 45 with a control valve 46 is provided for supplying preferably high-pressure, high purity inert gas into inert gas compartment 135, and a vent conduit 42 with a control valve 43 allows venting. A side tube 143 is connected to pressure vessel 31 at the bottom with one end and to the vent conduit 42 with another end. An additional control valve 138 is installed in vent conduit 42 between the joint of side tube 143 with vent conduit 42 and pressure vessel 31. There is preferably a branch conduit 50 connected to the side tube 143 with one end and to pressure vessel 31 at the topside wall with another end. As in the preferred embodiment illustrated in FIG. 1, four level sensors 51*a*–51*d* are preferably mounted on side tube 143 to monitor the chemical composition level inside pressure vessel 31. A mist eliminator 139 is preferred to remove any mist carried away from the composition.

The above-mentioned conduits and control valves are preferably comprised of materials compatible with chemical compositions to be delivered. Metal materials such as stainless steel, and plastic materials, such as PTFE, PFA, high-density polyethylene, and polypropylene, and the like, are preferred. The control valves are preferably pneumatic types. The mist eliminator could be any of those commercially available types of plastic fiber or membrane type.

Pressure vessel 31 is preferably comprised of similar materials and dimensions to the pressure vessel described in reference to FIG. 1. For accommodating both chemical composition 32 to be delivered and wetting composition 134 (preferably deionized water), pressure vessel 31 is partitioned into two separate compartments with a dividing means 133. Inert gas compartment 135 is located in the upper portion of pressure vessel 31 to accommodate wetting composition, such as deionized water or composition to be delivered. Chemical composition compartment 29 is located at the lower portion of pressure vessel 31 to accommodate chemical composition to be delivered. The two compartments communicate each other through a portion of vent conduit 137, side tubes 140 and 143, and the conduit 50. It may be preferred to include a valve in conduit 50 to allow wet inert gas to flow through conduit 143, thus bubbling the wet gas through the liquid chemical composition.

When the apparatus 100 is operated, chemical composition is first fed into composition compartment 29 through composition inlet conduit 20. At this time control valve 21 is open, control valve 23 is closed, inert gas control valve 138 is closed, and vent control valve 43 is open. When the composition inside compartment 29 reaches a high level monitored by level sensor 51*b*, control valve 21 is closed, and the filling is stopped. Wetting composition, such as deionized water or diluted chemical composition, is fed into inert gas compartment 135 to a controlled depth of the wetting composition, and the three-way valve to the composition supply side is closed. The depth of composition is preferably at least 2 inches (5 cm) to have the tip of the inert gas inlet conduit 154 embedded in the composition, although this is not strictly necessary. Wetting composition should be supplied into the compartment by turning on the three-way valve periodically to maintain a controlled composition level. Turning three-way valve 151 to the "composition out" position when needed discharges the waste composition inside compartment 135. The inert gas supplying control valve 46 is preferably always open to allow inert gas to fill the small compartment 135 at a controlled pressure. The inert gas (preferably high-purity nitrogen gas) bubbles though the wetting composition inside the gas compartment. Chemicals or water in the wetting composition then vaporize into inert gas. When composition 32 inside compartment 29 is to be delivered to user stations, vent valve 43 is closed, and control valve 138 is opened. Inert gas with vapor and/or moisture at a relative humidity about 50 to 100 percent flows through mist eliminator 139, conduits 137, 140, and 50 into the top portion of chemical compartment 29. Chemical composition to be delivered to end-users is pressurized by the high-pressure inert gas. When the composition outlet control valve 23 is open, the chemical composition flows through outlet conduit 22 to one or more user stations through a series of conduits and control devices. The delivery can be stopped at any time by closing control valve 23 and can be resumed by turning on this control valve. When the composition inside pressure vessel 31 reaches a low level monitored by level sensor 51*c*, turning off control valve 23 stops the delivery. At this time, inert gas control valve 138 is closed as well. Vent control valve 43 is turned on to release the pressure inside the pressure vessel. Chemical composition compartment 29 of pressure vessel 31 is then ready to be refilled. Such refill and discharge can be repeated for many circles. Two or more such pressure vessels 31 can be operated in parallel with one in delivery mode, and other one in refill mode for a continuous delivery of chemical compositions to user stations.

Two other level sensors 51*a* and 51*d* are used for monitoring high-high level and low-low level of chemical composition inside compartment 29 of pressure vessel 31. The signals from these two sensors are mainly for safety consideration. Once the level reaches either high-high or low-low level, an alarm will be produced and the system could be shut down within a preset time.

Figure 3:
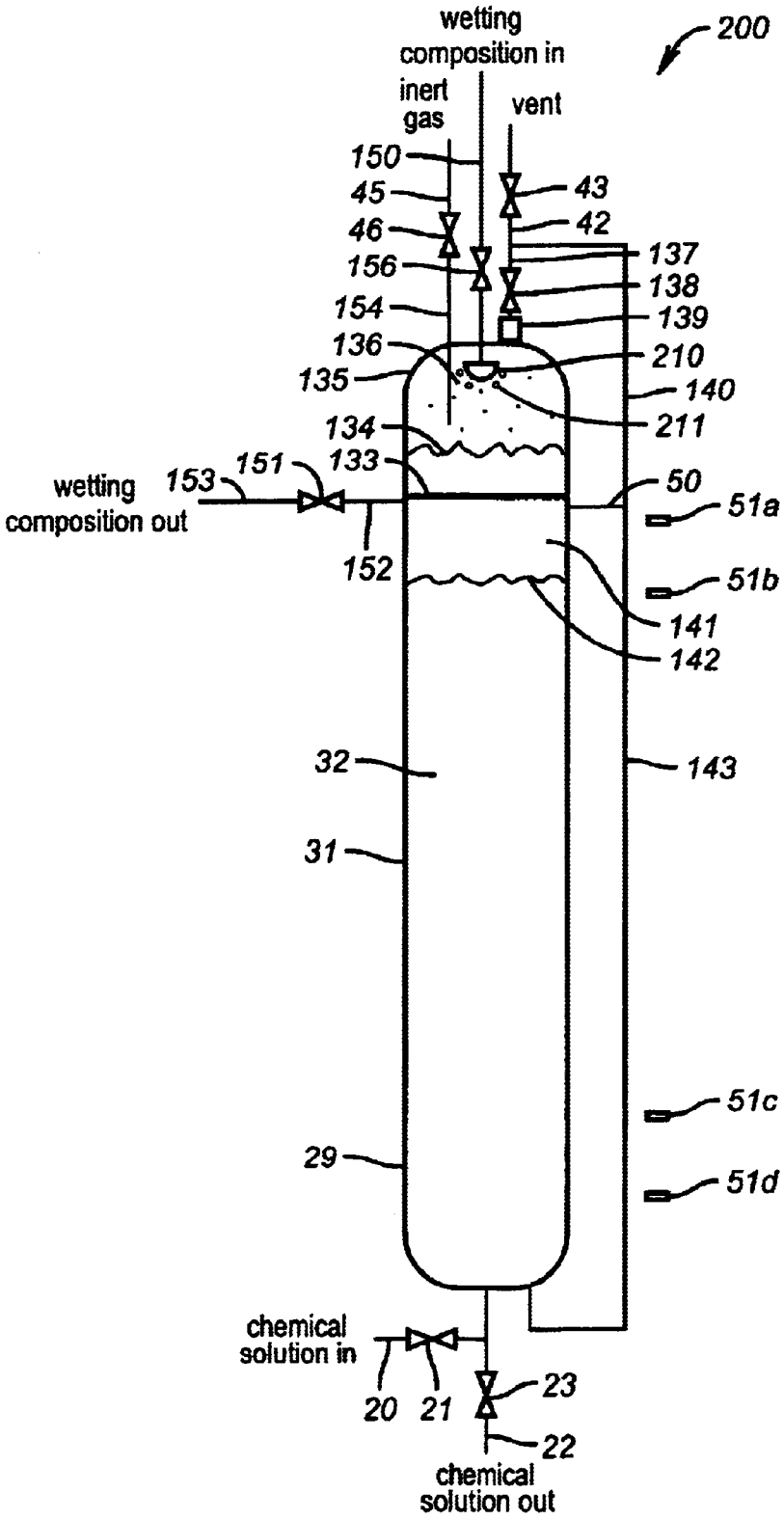
FIG. 3 is a process schematic, side elevation view of another compartment arrangement for the preferred embodiment of FIG. 2.

Wetting composition or diluted chemical composition can be supplied into gas compartment 135 of pressure vessel 31 through a conduit having a showerhead 210 located inside the compartment 135 as illustrated in FIG. 3. Spraying the wetting composition with the showerhead produces liquid droplets 211. Inert gas is supplied into gas compartment 135 through conduit 45 that is preferably extended nearly all of its length to near the bottom of gas compartment 135. Inert gas contacts liquid droplets 211 for transferring vapor and/or moisture to the inert gas, and then wet inert gas flows through mist eliminator 139, control valve 138, conduits 137, 140 and 50 into chemical composition compartment 29 to pressurize the chemical composition when it is necessary. Composition droplets will be collected on the dividing element 133, which functions as a floor of gas compartment 135 and establishes a level of wetting composition there, and discharged through conduit 153 with a control valve 151.

Figure 4:
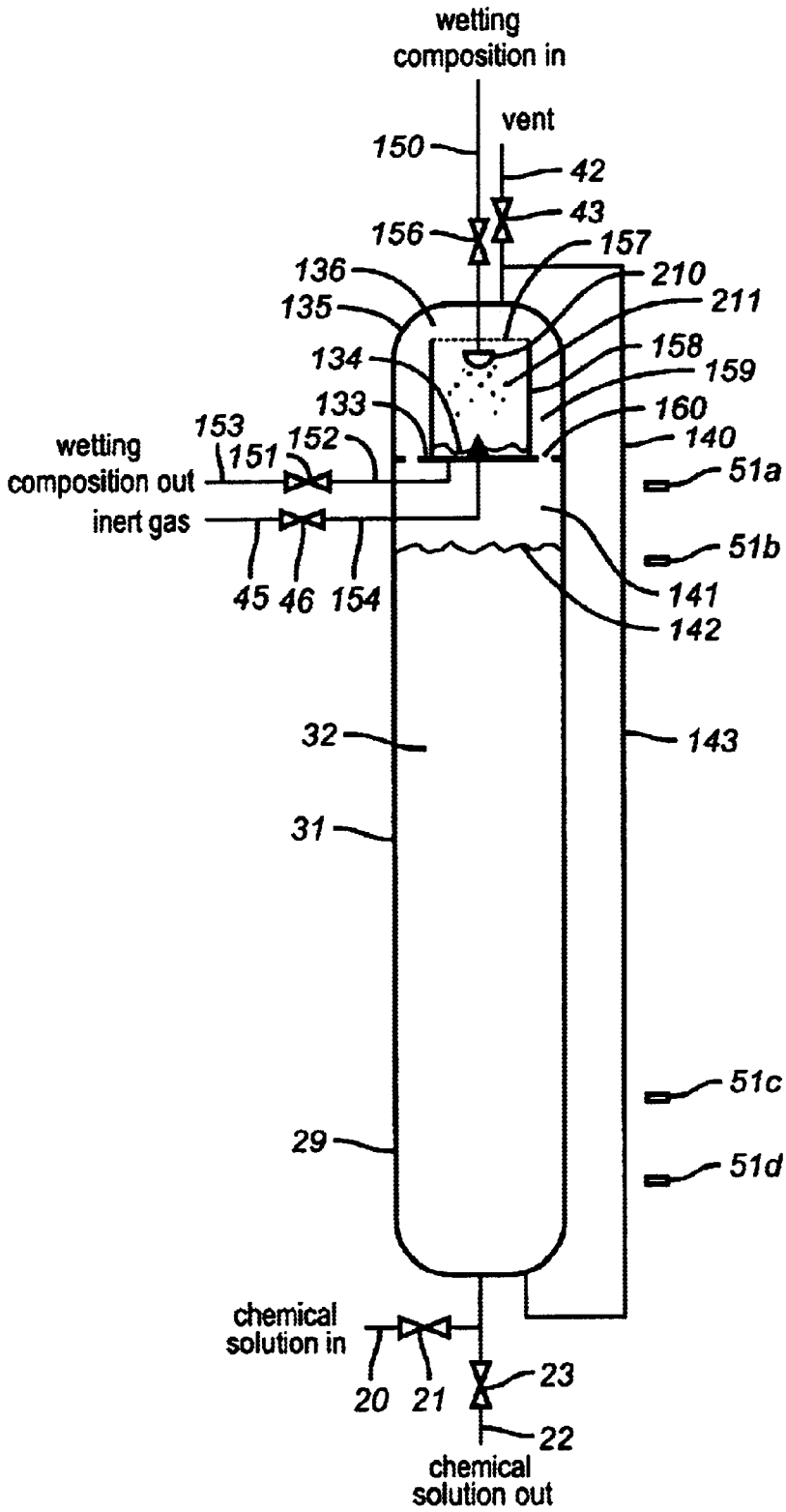
FIG. 4 is a process schematic, side elevation view of another preferred embodiment of an apparatus and method with two compartments and an internal communication arrangement.

FIG. 4 illustrates another preferred apparatus embodiment 500 of this invention. Compared with the embodiments illustrated in FIGS. 2 and 3, the embodiment in FIG. 4 has a housing 158 within gas compartment 135. A conduit 150 and valve 156 deliver a wetting composition through a showerhead 210, which functions to spray wetting composition within housing 158, as illustrated at 211. Inert gas is supplied into housing 158 as well through a conduit 45, valve 46, and conduit 154. There is provided means 157 for allowing inert gas with chemical vapor and/or moisture to flow out of housing 158. Means 157 is preferably selected from the group consisting of holes, louvered plates, bubble caps, and the like. To remove any droplets in the inert gas, mist-eliminating materials such as plastic fibers can be mounted to means 157. There is preferably an annular channel 159 between housing 158 and the interior wall of pressure vessel 31 to allow wet inert gas to pass through. On dividing means 133 for gas compartment 135 and chemical composition compartment 29 there are preferably a plurality of small holes 160 or like means for communication between the two compartments. Wet inert gas will flow through these holes or other means from gas compartment 135 into compartment 29 to pressurize chemical composition to be delivered.

During operation, as in the preferred embodiments referred to in FIGS. 1–3, chemical composition is fed into chemical composition compartment 29 of pressure vessel 31 through a chemical supplying conduit 20 with a control valve 21. Once the composition level reaches its high level monitored by level sensor 51*b*, control valve 21 is closed. Control valve 43 for vent is closed. Inert gas is supplied into housing 158 by turning on control valve 46. Wetting composition may be sprayed with showerhead 210 continuously to produce liquid droplets. Inert gas contacts the liquid droplets, and then flows into vapor space 136 within gas composition compartment 135, and further into the space 141 through the holes 160 to pressurize the chemical composition. Once it is necessary to deliver chemical composition to user stations, control valve 23 is opened, and chemical composition flows through conduit 22 to any necessary external conduits and control devices to user stations. Keeping the control valve 156 on can continuously spray wetting composition, and control valve 151 in the composition discharge conduit can also be kept open for continuous discharge.

Figure 4A:
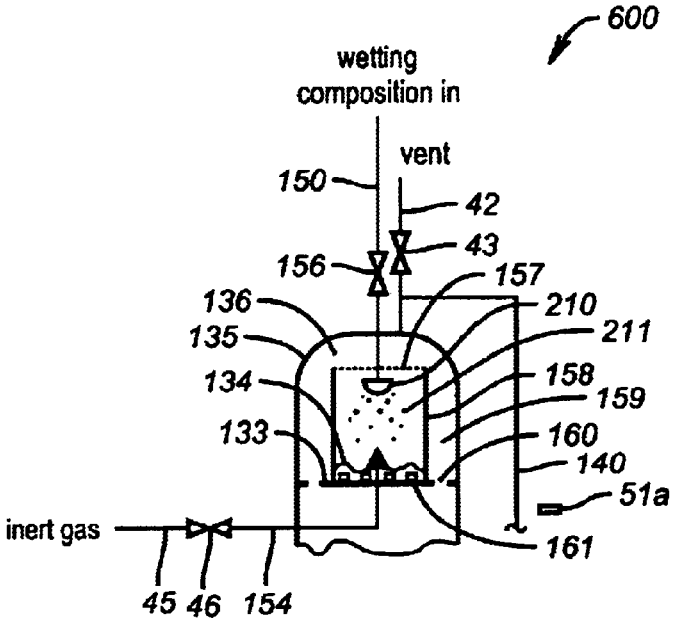
FIG. 4*a* is a partial process schematic, side elevation view of a modification of the embodiment of FIG. 4, including a plurality of housing openings.

FIG. 4*a* illustrates a fifth apparatus embodiment, which is a slight modification of the embodiment illustrated in FIG. 4. Illustrated is a plurality of openings 161 in housing 158 near and/or in its bottom, functioning to allow wetting composition to drip down in to liquid chemical composition to be delivered.

Figure 5:
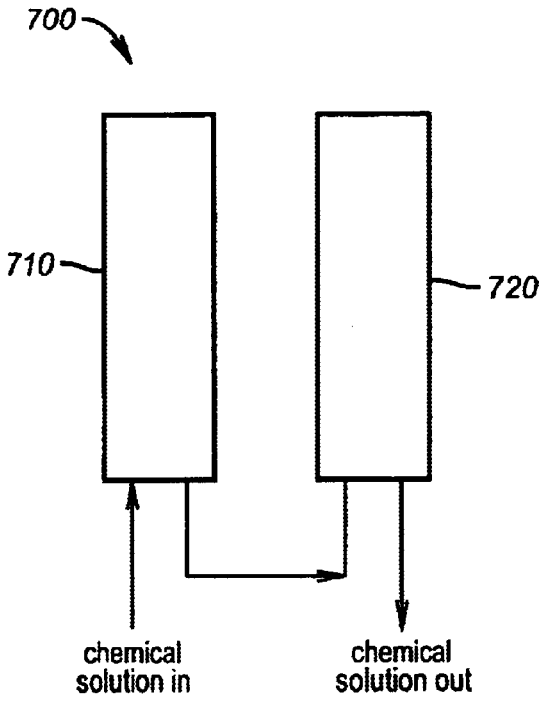
FIG. 5 is a process schematic, side elevation view of another preferred embodiment of an apparatus and method including two apparatuses in series.

FIG. 5 illustrates another embodiment 700 of the invention in which two apparatuses 710, 720 are connected in series. Preferably, any one of the apparatuses illustrated in FIG. 2, 3 or 4 may be used for each of the apparatuses 710, 720.

Figure 6:
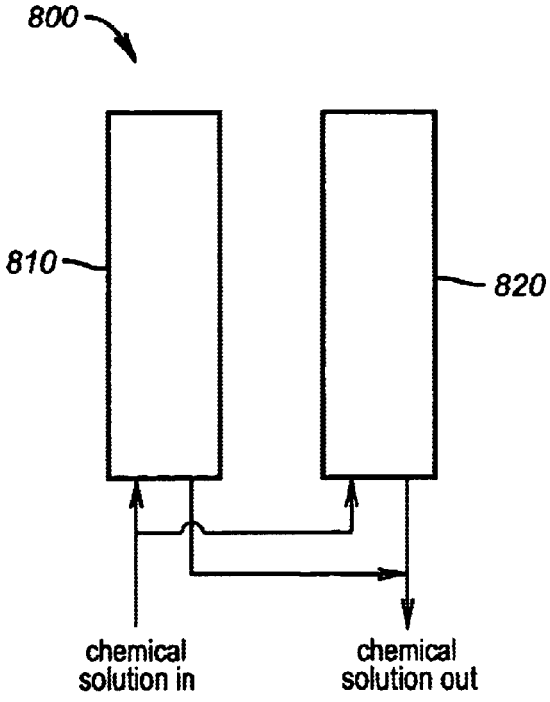
FIG. 6 is a process schematic, side elevation view of another preferred embodiment of an apparatus and method including two apparatuses in parallel.

FIG. 6 illustrates another embodiment 800 of the invention in which two apparatuses 810, 820 are connected in parallel. Preferably, any one of the apparatuses illustrated in FIG. 2, 3 or 4 may be used for each of the apparatuses 810, 820.

The above-mentioned preferred embodiments are preferably operated automatically with a computer control system or a PLC system. The control valves are preferably pneumatically operated and controlled with the automatic control system. Signals from monitoring devices such as level sensors are fed to the computer or PLC for processing and initiating a necessary operation signal to the system.

From the description of above-mentioned preferred embodiments that are illustrated in FIGS. 1, 2, 3, 4, 4*a*, 5 and 6, one can immediately realize the advantages of this invention. First, the preferred apparatus are easy to operate because they have all of the preferred functions in a preferably integrated apparatus. Chemical composition can be charged and discharged from the pressure vessel by operating several control valves. At the same time, high-pressure inert gas and, preferably, a wetting composition are supplied into the pressure vessel for evaporating chemical and/or water into the inert gas for pressurizing the chemical composition to be delivered. Therefore, no external device is needed to provide vapor to the inert gas. The assay of the chemical compositions to be delivered will not be substantially changed due to evaporation. The apparatus are also easily automated. Second, very precious space is saved because there is no additional external humidifier used for humidifying high-pressure inert gas. Third, the overall cost of the pressure system is significantly reduced because fewer devices are used for the same purpose as in known apparatus and methods.

Although the above description of preferred apparatus and processes of the invention are representative of the invention, they are by no means intended to limit the scope of the appended claims.

What is claimed is:

1. An apparatus for delivery of chemical compositions, the apparatus comprising:

a) a pressure vessel comprising an inlet and an outlet for a liquid chemical composition, and a vapor space, the pressure vessel adapted to contain the liquid chemical composition, the liquid chemical composition having a vaporizable portion therein;

b) means for contacting a dry inert gas with at least a portion of the liquid chemical composition in the pressure vessel to transfer at least a portion of the vaporizable portion from the chemical composition to the inert gas to form a wet inert gas in the vapor space; and c) means for pressurizing the chemical composition out of the vessel using the wet inert gas.

2. The apparatus of claim 1 wherein the inlet and the outlet are each legs of a tee connection, a remaining leg of the tee connected to the pressure vessel.

3. The apparatus of claim 1 wherein the dry inert gas is adapted to be sparged into the pressure vessel near a bottom of the vessel through an inert gas inlet conduit, the inert gas inlet conduit having an exit end.

4. The apparatus of claim 3 wherein the exit end of the inert gas inlet has a sparging device attached thereto.

5. The apparatus of claim 1 wherein the means for contacting is a means for bubbling.

6. The apparatus of claim 1 wherein there are two of said pressure vessels connected in series.

7. The apparatus of claim 1 wherein there are two of said pressure vessels connected in parallel.

8. A method of delivering a chemical composition, the method comprising the steps of:

a) filling a pressure vessel with a liquid chemical composition comprising a vaporizable component, the pressure vessel having a vapor space and adapted to contain the liquid chemical composition;

b) contacting a dry inert gas with at least a portion of the liquid chemical composition in the pressure vessel to transfer at least a portion of the vaporizable composition from the liquid chemical composition to the dry inert gas to form a wet inert gas in the vapor space; and c) pressurizing the liquid chemical composition out of the pressure vessel using the wet inert gas in the vapor space.

* * * * *